US009774124B2

(12) United States Patent
Kato et al.

(10) Patent No.: US 9,774,124 B2
(45) Date of Patent: Sep. 26, 2017

(54) CONNECTOR

(71) Applicant: ACES ELECTRONICS CO., LTD., Zhongli, Taoyuan County (TW)

(72) Inventors: Nobukazu Kato, Fussa (JP); Saeyong Shin, Yokohama (JP)

(73) Assignee: ACES ELECTRONICS CO., LTD, Zhongli (TW)

( * ) Notice: Subject to any disclaimer, the term of this patent is extended or adjusted under 35 U.S.C. 154(b) by 0 days.

(21) Appl. No.: 14/962,322

(22) Filed: Dec. 8, 2015

(65) Prior Publication Data

US 2016/0172776 A1 Jun. 16, 2016

(30) Foreign Application Priority Data

Dec. 12, 2014 (JP) ..... 2014-251807

(51) Int. Cl.
*H01R 13/453* (2006.01)
*H01R 13/24* (2006.01)
*H01R 12/71* (2011.01)

(52) U.S. Cl.
CPC ..... *H01R 13/4538* (2013.01); *H01R 12/716* (2013.01); *H01R 13/2428* (2013.01)

(58) Field of Classification Search
CPC H01R 13/447; H01R 13/453; H01R 13/4538; H01R 13/2428; H01R 13/2464; H01R 12/716
See application file for complete search history.

(56) References Cited

U.S. PATENT DOCUMENTS 6,048,228 A * 4/2000 Aso ..... H01R 13/2428 439/660
6,200,167 B1 * 3/2001 Aso ..... H01R 13/2428 439/660
6,312,295 B2 * 11/2001 Nishimatsu ..... H01R 13/2428 439/660
9,543,722 B2 1/2017 Kato et al.
2013/0045620 A1 * 2/2013 Li ..... H01R 13/6275 439/357

(Continued)

FOREIGN PATENT DOCUMENTS

JP 2006-173473 A 6/2006

*Primary Examiner* — James Harvey
*Assistant Examiner* — Oscar C Jimenez
(74) *Attorney, Agent, or Firm* — Chiesa Shahinian & Giantomasi PC

(57) ABSTRACT

A connector includes a contact having a contact point that is electrically coupled to a connecting terminal of an external device by pressing the connecting terminal onto the contact point, a protective member having an aperture for exposing the contact point from a surface of the side for pressing the external device and movable between a first position and a second position, a first shell covering the protective member with the aperture exposed, a base accommodating the contact and the protective member, and a ground contact having a first elastic portion that pushes up the protective member and the first shell, having a first held portion held by the base, and being grounded. The ground contact pushes up the protective member and the first shell with an elastic force of the first elastic portion. The contact point is positioned inside the protective member at the first position.

15 Claims, 21 Drawing Sheets

(56) References Cited

U.S. PATENT DOCUMENTS

| | | | | |
|---|---|---|---|---|
| 2015/0280343 | A1* | 10/2015 | Hsu | H01R 13/2421<br>439/607.01 |
| 2015/0311619 | A1* | 10/2015 | Kato | H01R 13/6594<br>439/137 |
| 2016/0036176 | A1* | 2/2016 | Kato | H01R 31/06<br>439/676 |

* cited by examiner

CONNECTOR

CROSS-REFERENCE TO RELATED APPLICATIONS

The present application claims the benefit of Japanese patent application number 2014-251807, filed on Dec. 12, 2014, the subject matter of which is hereby incorporated herein by reference in its entirety.

TECHNICAL FIELD

The present invention relates to a connector that is connected to a connecting terminal of an electronic device.

RELATED ART

Background Art

Conventionally, a cradle, for a handheld device, equipped with a connector having a spring terminal is known (for example, see Patent Literature 1). When a handheld device is attached to the cradle, the connecting terminal of the handheld device is pressed onto the spring terminal, and thereby the handheld device and the connector are electrically coupled to each other.

Pogo pin connectors including a plurality of movable pins that expands and contracts by springs (Pogo pin) and USB connectors of which USB terminal is directly inserted in connectors are also known.

CITATION LIST

Patent Literature

Patent Literature 1: Japanese Unexamined Patent Application Publication No. 2006-173473

SUMMARY OF INVENTION

Technical Problem

Such a cradle for a handheld device however has a disadvantage that a spring terminal significantly protruding from the surface of the connector may be touched by a finger or a tip of a pen to be deformed.

Moreover, the Pogo pin connector is disadvantageously high in manufacturing cost, and the USB connector is disadvantageously susceptible to damage during attaching and detaching of a USB terminal.

The object of the present invention is to provide a connector that is low in cost and almost free of trouble.

Solution to Problem

A connector according to the invention includes a contact having a contact point that is electrically coupled to a connecting terminal of an external device by pressing the connecting terminal onto the contact point, a protective member having an aperture for exposing the contact point from a surface of the side for pressing the external device and movable between a first position and a second position, a first shell covering the protective member with the aperture exposed, a base accommodating the contact and the protective member, and a ground contact having a first elastic portion that pushes up the protective member and the first shell in an opposite direction to a pressing direction of the connecting terminal of the external device, having a first held portion held by the base, and being grounded. The ground contact pushes up the protective member and the first shell with an elastic force of the first elastic portion, and the contact point of the contact is positioned inside the protective member at the first position.

The connector according to the invention further includes a second shell that is assembled to the base and electrically coupled to the first shell. The first shell has a second held portion that is held by the protective member, the second shell has a third held portion that is held by the base, the first shell or the second shell has a second elastic portion that is coupled to the second shell or the first shell, and the second shell is coupled to the first shell at least in the second position.

The connector according to the invention is configured that the contact has a pressing portion that presses the protective member toward the external device while the protective member is positioned from any one of positions between the first position and the second position to the second position.

The connector according to the invention is configured that at least two ground contacts disposed on both sides of the contact.

The connector according to the invention is configured that the ground contact and the second shell are integrally formed.

A connector according to the invention includes a contact having a contact point that is electrically coupled to a connecting terminal of an external device by pressing the connecting terminal onto the contact point, a protective member having an aperture for exposing the contact point from a surface of the side for pressing the external device and movable between a first position and a second position, a first shell having a second held portion held by the protective member and covering the protective member with the aperture exposed, a base accommodating the contact and the protective member, an elastic member having a first elastic portion that pushes up the protective member and the first shell in an opposite direction to a pressing direction of the connecting terminal of the external device, and having a first held portion held by the base, and a second shell being assembled to the base, having a third held portion held by the base, and being electrically coupled to the first shell. The first shell or the second shell has a second elastic portion that is coupled to the second shell or the first shell, and the second shell is coupled to the first shell at least in the second position.

The connector according to the invention is configured that the elastic member is a ground contact which is grounded.

The connector according to the invention is configured that the ground contact pushes up the protective member and the first shell with an elastic force of the first elastic portion, and the contact point of the contact positioned inside the protective member at the first position.

A connector according to the invention includes a contact having a contact point that is electrically coupled to an external device by pressing a connecting terminal provided on a pressing face of the external device onto the contact point, a protective member surrounding the contact point of the contact to protect the contact point, and a base being made of an insulative material and accommodating the contact and the protective member. The protective member includes an aperture for projecting toward the external device from a surface of a pressed face onto which the pressing face of the external device is pressed, and at least two protrusions being provided in opposite sides of the contact point on the pressed face being higher than the contact point. The contact includes at least a pressing portion that presses the protective member in an opposite direction to a pressing direction pressing the pressing face of the external device when in a first state and does not press the protective member in the opposite direction when in a second state, and the contact point projects toward the external device from the aperture when in the first state.

The connector according to the invention is configured that, in the second state, the protrusion is accommodated in a recess provided in the pressing face of the external device and the contact point is coupled to the connecting terminal of the external device.

The connector according to the invention configured that, in the first state, the protrusion is pressed in the pressing direction from an outside when the protrusion is not accommodated in the recess provided in the pressing face of the external device.

The connector according to the invention is configured that the protrusion has a triangular shape.

The connector according to the invention is configured that the base includes a fixing portion that fixes the protective member in the base, and the protective member includes a engaging portion that engages with the fixing portion.

Advantageous Effects of Invention

According to the present invention, a connector that is low in cost and almost free of trouble can be provided.

DESCRIPTION OF EMBODIMENTS

Figure 1:
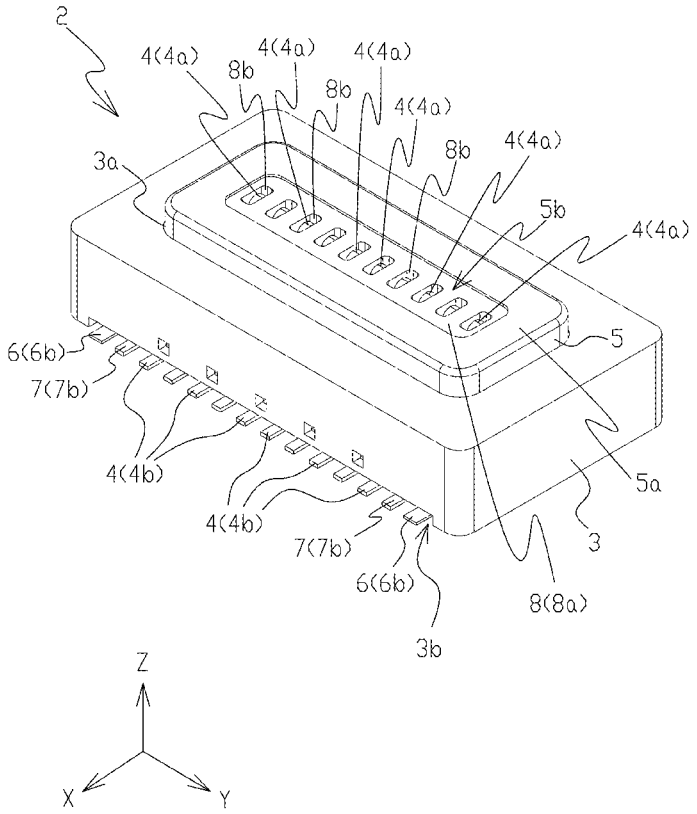
FIG. 1 is a perspective view illustrating an external appearance of a connector according to a first embodiment.
Figure 2:
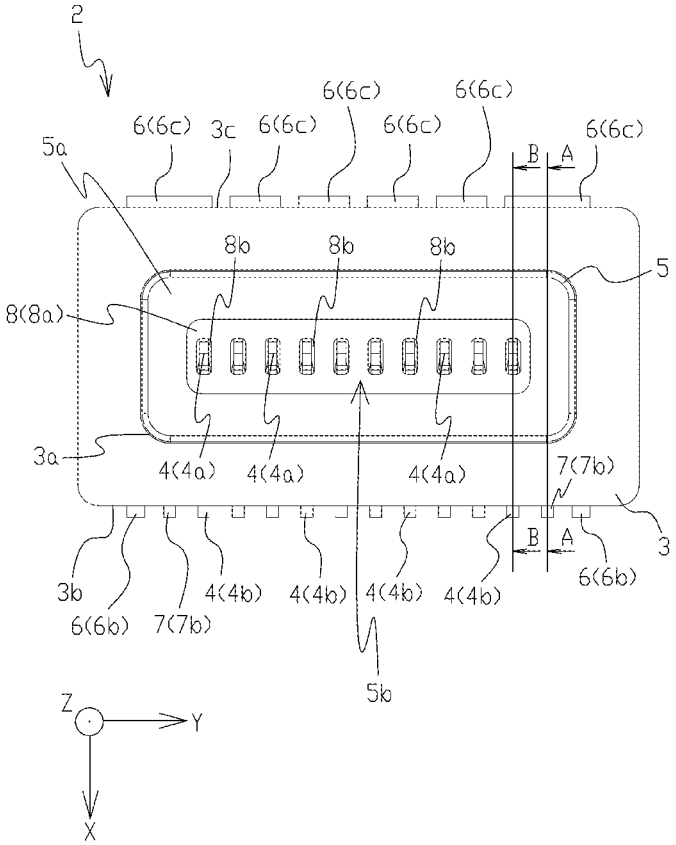
FIG. 2 is a top view illustrating an external appearance of the connector according to the first embodiment.

A connector according to a first embodiment will be described below referring to the drawings. A pressing-type connector that makes electrical contact with an external device (not shown), such as a handheld device, by pressing a connecting terminal of the external device onto the pressing-type connector will exemplarily be described. FIG. 1 is a perspective view illustrating an external appearance of a connector according to the first embodiment. FIG. 2 is a top view of the connector. An XYZ orthogonal coordinate system will be defined, and the description will be made with reference to the XYZ orthogonal coordinate system. As illustrated in FIG. 1, the XYZ orthogonal coordinate system is defined such that the XY plane is parallel with the bottom face of a connector 2 and the Z axis is normal to the XY plane.

The connector 2 includes a base 3, a protective member 8, a ground contact 7, a contact 4, a first shell 5, and a second shell 6. The base 3 is formed of an insulative member having an approximately cuboid shape. The base 3 accommodates the ground contact 7, the contact 4, and the protective member 8. As illustrated in FIGS. 1 and 2, a square-shaped first aperture 3*a* is provided on the top face (facing the +Z side) of the base 3. The protective member 8 for protecting a contact point 4*a* of the contact 4 is positioned so as to project from the top face of the base 3 through the first aperture 3*a*.

In the lower portion of the face of the base 3 facing the +X side, a second aperture 3*b* is provided in a form of a slit through which a lower end portion 4*b* of the contact 4, a lower end portion 7*b* of the ground contact 7, and two bent portions 6*b* in the +X side of a second shell 6 are exposed. The end portion 4*b* of the contact 4 exposed through the second aperture 3*b* is coupled to a power controller or a signal controller of an electronic device on which the connector 2 is mounted. The end portion 7*b* of the ground contact 7 and the two bent portions 6*b* of the second shell 6 are coupled to the ground of the electronic device. In the lower portion of the face of the base 3 facing the −X side, a third aperture 3*c* is provided in a form of a slit through which six bent portions 6*c* in the −X side of the second shell 6 are exposed. The six bent portions 6*c* of the second shell 6 exposed through the third aperture 3*c* are coupled to the ground of the electronic device on which the connector 2 is mounted. The end portion 4*b* of the contact 4 which is coupled to the power controller or the signal controller of the electronic device is disposed in the +X side of the connector 2, whereas the bent portion 6*c* of the second shell 6 which is coupled to the ground of the electronic device is disposed in the −X side of the connector 2. This arrangement is advantageous in reducing noise.

Figure 3:
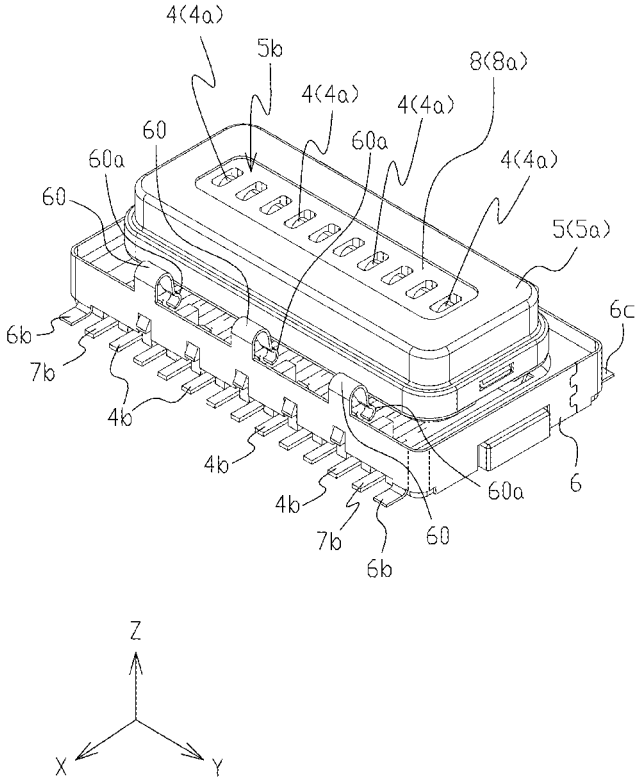
FIG. 3 is a perspective view illustrating the connector according to the first embodiment without a base.
Figure 4:
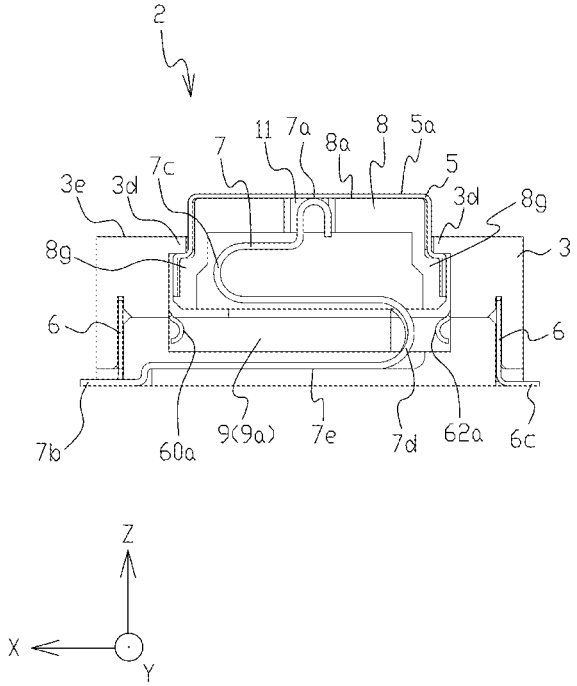
FIG. 4 is a sectional view illustrating a configuration of a ground contact of the connector according to the first embodiment.
Figure 5:
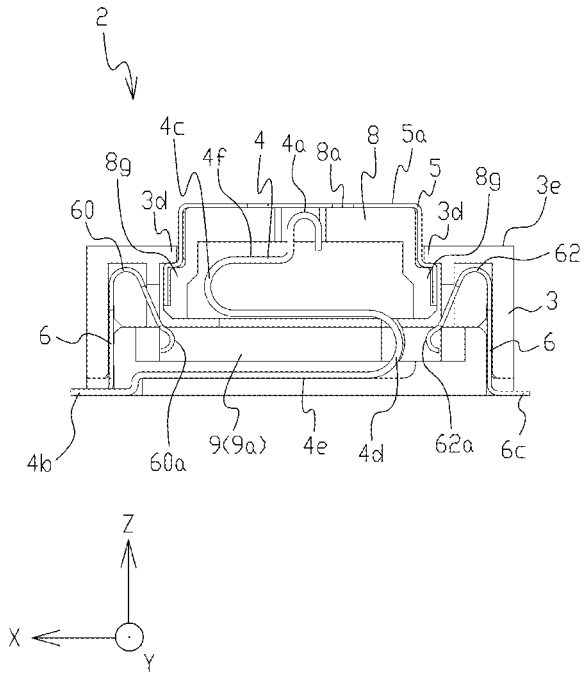
FIG. 5 is a sectional view illustrating a configuration of a contact of the connector according to the first embodiment.

FIG. 3 is a perspective view illustrating the connector 2 according to the first embodiment without a base 3. FIG. 4 is a sectional view of the connector 2 according to the first embodiment illustrated in FIG. 2 taken along the line A-A in FIG. 2. FIG. 5 is a sectional view of the connector 2 according to the first embodiment taken along the line B-B in FIG. 2. In FIGS. 4 and 5, the protective member 8 is positioned in a first position where the external device is not yet pressed in the −Z direction onto the top surface 8*a* of the protective member 8.

An inward protrusion 3*d* that protrudes toward the inside of the base 3 is provided in the upper portion (in the +Z side) of the base 3. Therefore when the protective member 8 moves in the +Z direction, the protective member 8 (an outward protrusion 8*g*, which will be described later) is fixed by the inward protrusion 3*d*, so that the protective member 8 does not come off the base 3.

The protective member 8 is formed of an insulative member and is allowed to move along the Z direction between the first position and a second position which will be described later (see FIGS. 6 and 7). The protective member 8 covers from above a plurality of (ten, in the embodiment) contacts 4 accommodated in the base 3 and a plurality of (two, in the embodiment) ground contacts 7. On the top surface (the surface which the external device presses) 8*a* of the protective member 8, a plurality of (ten, in the embodiment) square-shaped apertures 8*b* arrayed along the Y direction is provided. The contact point 4*a* of each of a plurality of contacts 4 is exposed through the aperture 8*b* out of the top surface 8*a*. The contact point 4*a* has a U-shaped portion and makes contact with the connecting terminal of the external device when the external device presses the contact point 4*a* from above. An outward protrusion 8*g* that protrudes toward the outside of the protective member 8 is provided on the lower portion of the protective member 8. As described above, the inward protrusion 3*d* of the base 3 fixes the outward protrusion 8*g*, so that the protective member 8 does not come off the base 3.

As illustrated in FIGS. 4 and 5, the base 3 has inside an approximately cuboid-shaped hollow 9. The protective member 8 is arranged in the upper side of the hollow 9. The part of the base 3 for fixing and holding the contact 4 and the ground contact 7 at predetermined position is arranged on the lower side of the hollow 9. A space 9*a* is provided between the protective member 8 and the base 3 to allow the movement of the protective member 8 in the −Z direction.

Figure 6:
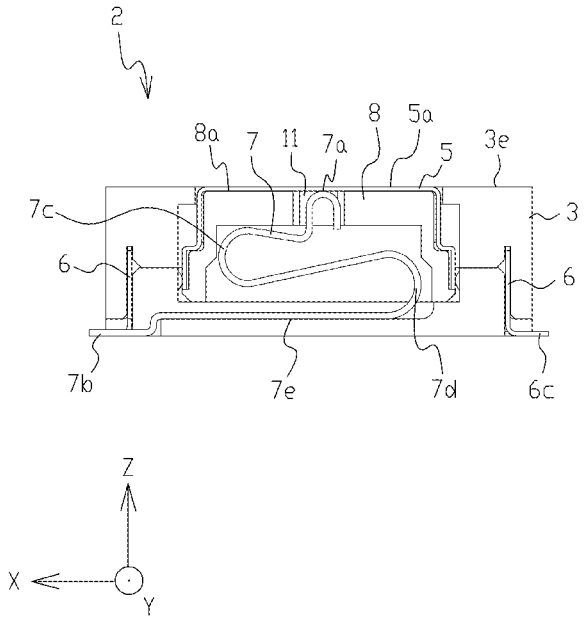
FIG. 6 is a sectional view illustrating a configuration of the ground contact of the connector according to the first embodiment.

FIG. 6 is a sectional view of the connector 2 according to the first embodiment taken along the line A-A in FIG. 2. FIG. 7 is a sectional view of the connector 2 according to the first embodiment taken along the line B-B in FIG. 2. In FIGS. 6 and 7, the protective member 8 is positioned in a second position with the external device pressing the top surface 8*a* of the protective member 8 in the −Z direction.

The ground contact 7 is formed of a conductive member having an approximately S-shape as illustrated in FIGS. 4 and 6. The ground contacts 7 are disposed along the array of the contacts 4 (Y direction) and on both sides of the array. The ground contact 7 has a contact point 7*a* provided on the top of the approximately S-shape to be electrically coupled to the first shell 5, an end portion 7*b* exposed to the −Z side through the second aperture 3*b*, a first elastic portions 7*c* and 7*d* provided between the contact point 7*a* and the end portion 7*b*, and a first held portion 7*e* provided between the first elastic portion 7*d* and the end portion 7*b*. The end portion 7*b* of the ground contact 7 is grounded. The first elastic portions 7*c* and 7*d* press the protective member 8 and the first shell 5 in the opposite direction (+Z direction) to the pressing direction (−Z direction) of the connecting terminal of the external device. The first held portion 7*e* is held by the base 3 and receives the elastic force of the first elastic portions 7*c* and 7*d*.

A hollow 11 is provided in the protective member 8 to expose the first shell 5 to the −Z side. The contact point 7*a* of the ground contact 7 is disposed in the hollow 11 and is continuously in contact with the first shell 5 exposed to the −Z side. The contact point 7*a* continuously pushes the protective member 8 and the first shell 5 up in the +Z direction by the elastic force of the first elastic portions 7*c* and 7*d*.

Figure 7:
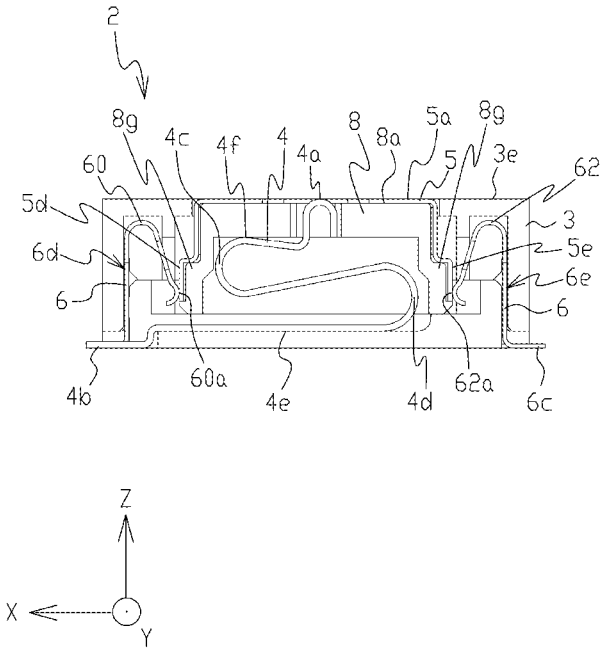
FIG. 7 is a sectional view illustrating a configuration of the contact of the connector according to the first embodiment.

The contact 4 is formed of a conductive member having an approximately S-shape as illustrated in FIGS. 5 and 7. The contact 4 has a contact point 4*a* provided on the top of the approximately S-shape and an end portion 4*b* in the −Z side exposed through the second aperture 3*b*. The contact point 4*a* of the contact 4 is electrically coupled to the connecting terminal of the external device when the external device presses the first shell 5 and the protective member 8. The contact point 4*a* of the contact 4 is positioned inside the aperture 8*b*, namely positioned in the inside (to the −Z direction) of the protective member 8 in the first position, because the protective member 8 and the first shell 5 are being pushed up by the ground contact 7. The end portion 4*b* of the contact 4 is connected to the power controller or the signal controller of the electronic device on which the connector 2 is mounted.

The contact 4 has a pressing portion 4*f* provided between the contact point 4*a* and the end portion 4*b*, elastic portions 4*c* and 4*d* provided between the pressing portion 4*f* and the end portion 4*b*, and a held portion 4*e* provided between the elastic portion 4*d* and the end portion 4*b*. As illustrated in FIG. 5, the pressing portion 4*f* is not in contact with the protective member 8 in the first position. When a user presses down the protective member 8 and the first shell 5 without pressing down the contact point 4*a*, the pressing portion 4*f* comes into contact with the protective member 8 at a position between the first position and the second position. As illustrated in FIG. 7, after the pressing portion 4*f* has come into contact with the protective member 8, the pressing portion 4*f* presses the protective member 8 toward the external device (in the +Z direction) until the protective member 8 and the first shell 5 move to the second position, and also while the protective member 8 and the first shell 5 are in the second position. While the protective member is pressed by the pressing portion 4*f*, the elastic portions 4*c* and 4*d* push the protective member 8 and the first shell 5 up in the +Z direction, and the held portion 4*e* is held by the base 3 and receives the elastic force from the first elastic portions 4*c* and 4*d*.

After the pressing portion 4*f* has come into contact with the protective member 8, the contact 4 and the ground contact 7 support the protective member 8 and the first shell 5 until the protective member 8 and the first shell 5 move to the second position, and also while the protective member 8 and the first shell 5 are in the second position. Thus the force pushing up the protective member 8 and the first shell 5 is applied in a distributed manner. Similarly, when a user releases a hand from pressing down the protective member 8 and the first shell 5, or detaches, from the connector 2, the external device that has been pressing the connector 2, the contact 4 and the ground contact 7 support the protective member 8 and the first shell 5 while the pressing portion 4*f* is pressing the protective member 8 to move from the second position to the first position. Thus the force pushing up the protective member 8 and the first shell 5 is applied in a distributed manner. Therefore, deformation of or damage to the protective member 8 and the first shell 5 caused by the concentration of a pushing up force can be prevented.

The first shell 5 is formed of a conductive member. When the external device presses the first shell 5, the first shell 5 comes into contact with the ground, such as a shell, provided on the external device. By the first shell 5 making contact with the ground of the external device, the external device and the electronic device on which the connector 2 is mounted are grounded via the ground contact 7 and the second shell 6. As illustrated in FIGS. 3 to 7, the first shell 5 includes an aperture 5*b* through which a plurality of apertures 8*b* are exposed. The first shell 5 covers the protective member 8 with a plurality of apertures 8*b* exposed. The first shell 5 is allowed to move together with the protective member 8 from the first position to the second position. The first shell 5 includes a face 5*d* facing the +X side and covering the outward protrusion 8*g* of the protective member 8. The face 5*d* serves as a second held portion held by the protective member 8 to receive the elastic force of a spring 60, which will be described later. Similarly, the first shell 5 includes a face 5*e* facing the −X side and covering the outward protrusion 8*g* of the protective member 8. The face 5*e* serves as a second held portion held by the protective member 8 to receive the elastic force of a spring 62, which will be described later. As illustrated in FIGS. 3 to 7, the first shell 5 covers the upper portion of the protective member 8 and the outward protrusion 8*g* provided in the lower portion of the protective member 8. Therefore, the first shell 5 is fixed by the inward protrusion 3*d* of the base 3, and thus the first shell 5 does not come off the base 3. The first shell 5 in the embodiment is formed by press work, although any shell formed by bending a metal sheet may be used.

The second shell 6 is formed of a conductive member. As illustrated in FIGS. 3 to 7, the second shell 6 is assembled to the base 3 to cover the inner periphery of the base 3, that is, to cover the outer periphery of the protective member 8 and the first shell 5. The second shell 6 includes two bent portions 6*b* in the +X side at both ends along the Y direction and six bent portions 6*c* in the −X side at both ends along the Y direction. The bent portions 6*b* and 6*c* are coupled to the ground of the electronic device on which the connector 2 is mounted. As illustrated in FIG. 3, the second shell 6 includes three springs 60 in the +Z side of the +X side. The end of the spring 60 has a chevron-shaped contact point 60*a*. The spring 60 is formed so that the contact point 60*a* is bent to the first shell 5 side (to the −X side), and furthermore the contact point 60*a* is bent to the −Z side. A face 6*d* in the +X side of the second shell 6 serves as a third held portion held by the base 3 and receives the elastic force of the spring 60.

The second shell 6 includes a spring 62 and two springs (not shown) in the +Z side of the −X side. A curved portion provided on an end of the spring 62 has a contact point 62*a*. The spring 62 is bent so as the contact point 62*a* is positioned closer to the first shell 5 (to the +X side) than the other end of the spring 62 and further to the −Z side than the bent. Each of the two springs (not shown) is formed in a manner similar to the spring 62. A face 6*e* in the −X side of the second shell 6 serves as a third held portion held by the base 3 and receives the elastic force of the spring 62 and the two springs (not shown) acting along the X direction.

As illustrated in FIGS. 4 and 6, the second shell 6 is not in contact with the first shell 5 when in the first position, but the contact points 60*a* and 62*a* of the springs 60 and 62 of the second shell 6 is coupled to the first shell 5 as the first shell 5 moves from the first position to the second position. As illustrated in FIGS. 5 and 7, from where the second shell 6 (the contact points 60*a* and 62*a* of the springs 60 and 62) has come into contact with the first shell 5 to the second position, the contact points 60*a* and 62*a* press the first shell 5, by the elastic force of the springs 60 and 62, and the second shell 6 is electrically coupled to the first shell 5. The second shell 6 is coupled to the first shell 5 at least in the second position.

In the first embodiment, how the protective member 8 and the contact point 4*a* move when the handheld device, which is an external device, is attached to the connector 2 for charging will exemplarily be described. A user first prepares the connector 2 and a handheld device to be charged.

Before the handheld device is pressed onto the connector 2, the ground contact 7 pushes up the protective member 8 and the first shell 5, and the inward protrusion 3*d* of the base 3 fixes the outward protrusion 8*g* of the protective member 8, as illustrated in FIG. 4. The protective member 8 and the first shell 5 are kept at a position (first position) where the top surface 5*a* of the first shell 5 projects from the top surface 3*e* of the base 3 by, for example, 1.0 mm without the protective member 8 and the first shell 5 coming off the base 3 (initial state). In the first position, as illustrated in FIG. 5, the contact point 4*a* of the contact 4 is positioned by a certain amount from the top surface 8*a* and the elastic portions 4*c* and 4*d* produce no elastic force.

When the connecting terminal of the handheld device is pressed onto the top surface 5*a* of the first shell 5 (the top surface 8*a* of the protective member 8), the first shell 5 and the ground (i.e., a shell) of the handheld device are coupled to each other, and thereby the handheld device and the electronic device on which the connector 2 is mounted are grounded via the ground contact 7. Then by applying a pressing force in the −Z direction to the protective member 8, the protective member 8, the first shell 5, and the contact point 7*a* of the ground contact 7 move in the −Z direction, and the ground contact 7 is compressed along the Z direction. By the movement of the protective member 8, the first shell 5, and the contact point 7*a* of the ground contact 7 in the −Z direction by, for example, 0.2 mm, the contact point 4*a* of the contact 4 that has been positioned inside the protective member 8 before the movement is positioned to be in plane with the top surface 5*a* of the first shell 5 and electrically coupled to the connecting terminal of the handheld device.

By further pressing the handheld device onto the top surface 5*a* of the first shell 5 (the top surface 8*a* of the protective member 8), the protective member 8, the first shell 5, the contact point 7*a* of the ground contact 7, and the contact point 4*a* of the contact 4 further move in the −Z direction by, for example, 0.2 mm (0.4 mm from the first position), and thereby the contact points 60*a* and 62*a* of the springs 60 and 62 of the second shell 6 are electrically coupled to the first shell 5. Since the handheld device and the electronic device on which the connector 2 is mounted are grounded not only via the first shell 5 and the ground contact 7 but also via the first shell 5 and the second shell 6, noise is further suppressed. Furthermore, by the elastic force of the elastic portions 4*c* and 4*d* of the contact 4, the connecting terminal of the handheld device can surely press the contact point 4*a* to securely couple together the connecting terminal of the handheld device.

By further moving downward the protective member 8, the first shell 5, the contact point 7*a* of the ground contact 7, and the contact point 4*a* of the contact 4 by, for example, 0.6 mm, (1.0 mm from the first position), the protective member 8 comes into contact with the base 3 to stop at where the top surface 5*a* of the first shell 5 is in plane with the top surface 3*e* of the base 3, as illustrated in FIGS. 6 and 7. Now the protective member 8 is in the second position where the top surface 5*a* of the first shell 5 is in plane with the top surface 3*e* of the base 3 and the contact point 4*a* is in plane with the top surface 5*a* (final connection state). In the final connection state, the contact point 4*a* is continuously pushed upward by the elastic force of the compressed contact 4. Thus the contact point 4*a* is in contact with the connecting terminal of the handheld device with a sufficient contact force. So that the handheld device can surely be charged via the connector 2.

The connector 2 according to the first embodiment protects the contact point 4*a* by surrounding the contact point 4*a* within, namely, positioning the contact point 4*a* inside, the protective member 8 having a simple structure. A low cost connector with little chance of trouble can thus be provided. For example, since the contact point 4*a* is protected by being positioned inside the protective member 8, deformation of or damage to the contact 4 caused by a finger or a pen touching the connector 2 positioned in the first position can be prevented.

The connector 2 according to the first embodiment includes the first shell 5, the second shell 6, and the ground contact 7. The external device and the electronic device on which the connector 2 is mounted are sufficiently grounded via the first shell 5, the second shell 6, and the ground contact 7. Conventional pressing-type connectors (e.g., a Pogo pin connector) are almost incapable of having high-speed transmission property. Besides, the connector 2 according to the embodiment is capable of providing secure grounding and thus having improved high-speed transmission property. Furthermore, the ground contact 7 continuously couples with the ground of the external device via the first shell 5 during the period of time from the start of pressing the external device onto the connector 2 until the finish of the pressing, the period of pressing and the period of time from the start of releasing the pressing until the finish of releasing the pressing. This grounding is advantageous for building a sequence.

In the final connection state, the contact point 4*a* is in contact with the connecting terminal of the external device with a sufficient pressing force. With the contact point 4*a* being surrounded within, namely positioned inside, the protective member 8 without the top portion of the contact 4 being exposed out of the connector 2, the external appearance is preferable.

Figure 8:
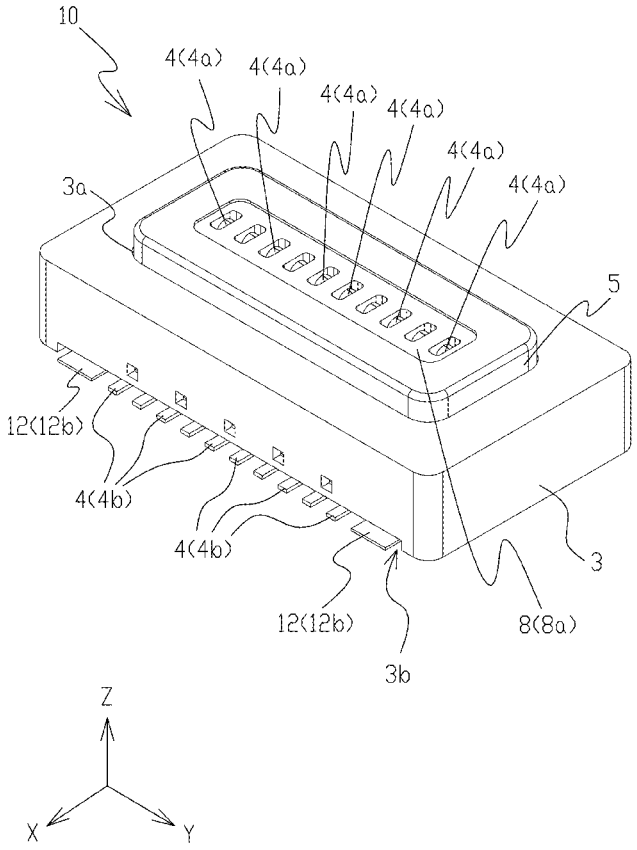
FIG. 8 is a perspective view illustrating an external appearance of a connector according to a second embodiment.
Figure 9:
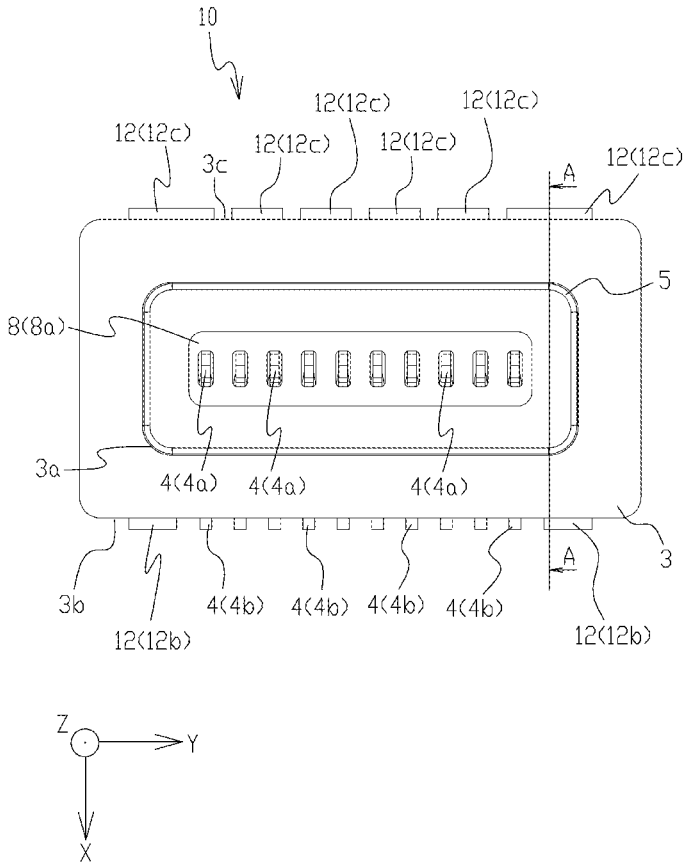
FIG. 9 is a top view illustrating an external appearance of the connector according to the second embodiment.
Figure 10:
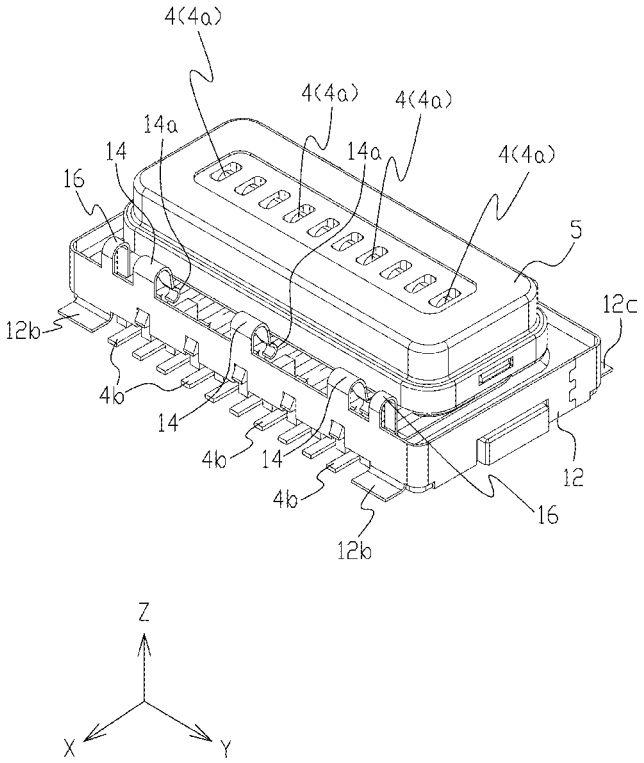
FIG. 10 is a perspective view illustrating the connector according to the second embodiment without a base.

A connector according to a second embodiment of the present invention will now be described referring to the drawings. The connector according to the second embodiment is electrically coupled to a connecting terminal of an external device (not shown), such as a handheld device, by pressing the external device on the connector. FIG. 8 is a perspective view illustrating an external appearance of the connector according to the second embodiment. FIG. 9 is a top view of the connector. FIG. 10 is a perspective view illustrating the connector 2 according to the second embodiment without a base 3. For the connector according to the second embodiment, the same component as the connector 2 illustrated in FIGS. 1 to 7 is appended with the same reference sign and the description thereof will be omitted. In the drawings illustrating a configuration of the connector according to the embodiment (FIGS. 8 to 12), an XYZ orthogonal coordinate system similar to that in FIGS. 1 to 7 is defined. Positional relationship between components will be described with reference to the XYZ orthogonal coordinate system.

The connector 10 includes a base 3, a protective member 8, a contact 4, a first shell 5, and a second shell 12. A lower end portion 4*b* of the contact 4 and a bent portion 12*b* in the +X side of the second shell 12 are exposed through a second aperture 3*b* of the base 3. A bent portion 12*c* of the second shell 12 is exposed through the third aperture 3*c* of the base 3. The bent portions 12*b* and 12*c* of the second shell 12 are coupled to the ground of an electronic device on which the connector 10 is mounted. The protective member 8 covers from above a plurality of (ten, in the embodiment) contacts 4 accommodated in the base 3 and a plurality of (two, in the embodiment) ground contacts 16, which will be described later. The end portion 4*b* of the contact 4 which is coupled to a power controller or a signal controller of the electronic device is disposed in the +X side of the connector 10, whereas the bent portion 12*c* of the second shell 12 which is coupled to the ground of the electronic device is disposed in the −X side of the connector 10. This arrangement is advantageous in reducing noise.

Figure 11:
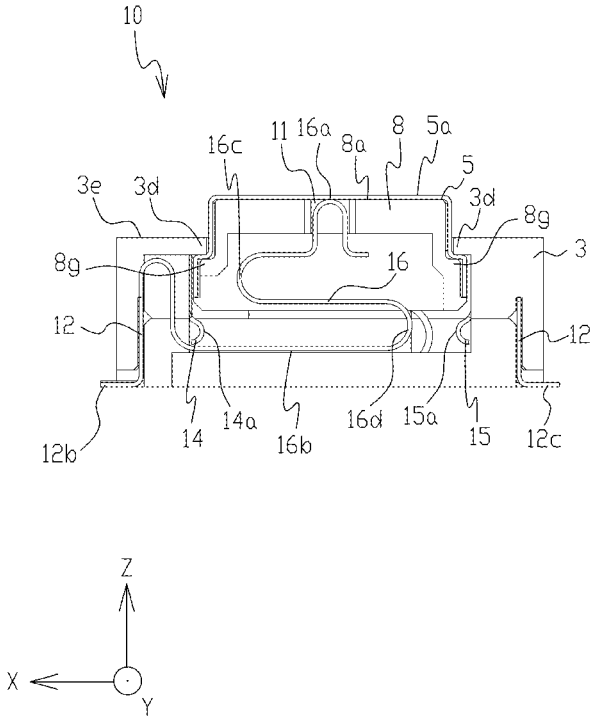
FIG. 11 is a sectional view illustrating a configuration of a ground contact of the connector according to the second embodiment.
Figure 12:
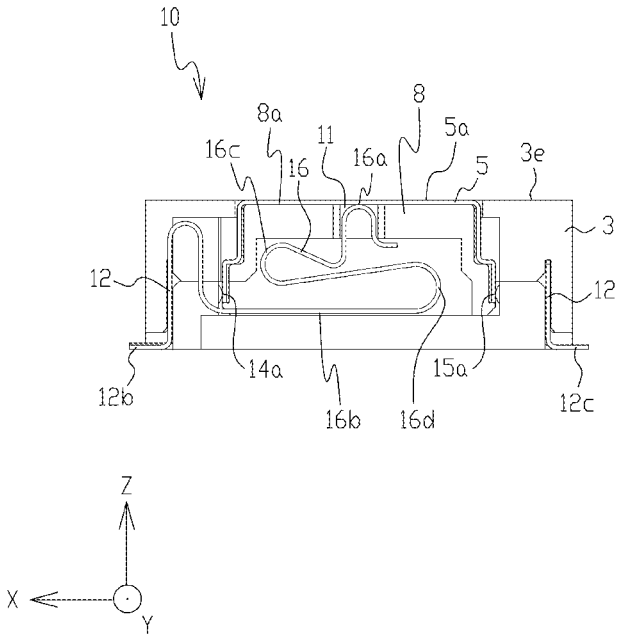
FIG. 12 is a sectional view illustrating the configuration of the ground contact of the connector according to the second embodiment.

FIGS. 11 and 12 are sectional views each illustrating a configuration of the connector 10 according to the second embodiment taken along the line A-A in FIG. 9. In FIG. 11, the protective member 8 is positioned in a first position where a top surface 8*a* of the protective member 8 is not yet pressed in the −Z direction by the external device. In FIG. 12, the protective member 8 is positioned in a second position where the top surface 8*a* of the protective member 8 is pressed in the −Z direction by the external device.

The second shell 12 is formed of a conductive member. As illustrated in FIGS. 9 to 12, the second shell 12 is assembled to the base 3 to cover the inner periphery of the base 3, that is, to cover the outer periphery of the protective member 8 and the first shell 5. The second shell 12 includes two bent portions 12*b* in the +X side along the Y direction and six bent portions 12*c* in the −X side along the Y direction. The bent portions 12*b* and 12*c* are coupled to the ground of the electronic device on which the connector 10 is mounted. As illustrated in FIG. 10, the second shell 12 includes three springs 14 in the +Z side of the +X side. The end of the spring 14 has a chevron-shaped contact point 14*a*. The spring 14 is formed so that the contact point 14*a* is bent to the first shell 5 side (to the −X side), and furthermore the contact point 14*a* is bent to the −Z side. A face in the +X side of the second shell 12 serves as a held portion held by the base 3 and receives the elastic force of the spring 14.

The second shell 12 includes a spring 15 and two springs (not shown) in the +Z side of the −X side. The end of the spring 15 has a chevron-shaped contact point 15*a*. The spring 15 is formed so that the contact point 15*a* is bent to the first shell 5 side (to the −X side), and furthermore the contact point 15*a* is bent to the −Z side. Each of the two springs (not shown) is formed in a manner similar to the spring 15. A face in the −X side of the second shell 12 serves as a held portion held by the base 3 and receives the elastic force of the spring 15 and the two springs (not shown).

The second shell 12 includes two ground contacts 16 in the +X side at both ends along the Y direction. That is, the second shell 12 and the ground contacts 16 of the second embodiment are integrated. As illustrated in FIGS. 11 and 12, the ground contact 16 has a contact point 16*a* to be electrically coupled to the first shell 5, a first held portion 16*b* held by the base 3, and first elastic portions 16*c* and 16*d* provided between the contact point 16*a* and the first held portion 16*b*. The contact point 16*a* is provided on a U-shaped portion provided on the end of the ground contact 16. The first held portion 16*b* is provided between the first elastic portion 16*d* and the bending portion of the ground contact 16 that is folded from +Z direction to −Z direction and bent to −X direction. The first elastic portions 16*c* and 16*d* push the protective member 8 and the first shell 5 up in the +Z direction. The first held portion 16*b* is held by the base 3 and receives the elastic force from the first elastic portions 16*c* and 16*d*.

As illustrated in FIG. 11, the second shell 12 is not in contact with the first shell 5 in the first position, but the contact points 14*a* and 15*a* of the springs 14 and 15 of the second shell 12 come into contact with the first shell 5 as the first shell 5 moves from the first position to the second position. As illustrated in FIG. 12, while the second shell 12 (the contact points 14*a* and 15*a* of the springs 14 and 15) moves from the start of coming into contact with the first shell 5 to the second position, the contact points 14*a* and 15*a* press the first shell 5 by the springs 14 and 15 with the elastic force. Therefore the second shell 12 keeps in contact with the first shell 5. The second shell 12 is coupled to the first shell 5 at least in the second position.

The contact point 16*a* of the ground contact 16 is disposed in the hollow 11 so as to continuously contact the portion of the first shell 5 exposed to the −Z side. The contact point 16*a* pushes up, by the elastic force of the first elastic portions 16*c* and 16*d*, the protective member 8 and the first shell 5 in the +Z direction.

In the second embodiment, how the protective member 8 and the contact point 4*a* move when the handheld device, which is an external device, is attached to the connector 10 for charging will exemplarily be described. A user first prepares the connector 10 and a handheld device to be charged.

Before the handheld device presses the connector 10, the ground contact 16 pushes up the protective member 8 and the first shell 5, and the inward protrusion 3*d* of the base 3 is stopping the movement of the outward protrusion 8*g* of the protective member 8, as illustrated in FIG. 11. The protective member 8 and the first shell 5 are kept at a position (first position) where the top surface 5*a* of the first shell 5 projects from the top surface 3*e* of the base 3 by, for example, 1.0 mm without the protective member 8 and the first shell 5 coming off the base 3 (initial state).

When the connecting terminal of the handheld device is pressed onto the top surface 5*a* of the first shell 5 (the top surface 8*a* of the protective member 8), the first shell 5 and the ground (i.e., a shell) of the handheld device are coupled to each other, and thereby the handheld device and the electronic device on which the connector 10 is mounted are grounded via the ground contact 16 (the second shell 12). Then by applying a pressing force to the protective member 8 in the −Z direction, the protective member 8, the first shell 5, and the contact point 16*a* of the ground contact 16 move in the −Z direction, and the ground contact 16 is compressed along the Z direction. By the movement in the −Z direction of the protective member 8, the first shell 5, and the contact point 16*a* of the ground contact 16 by, for example, 0.2 mm, the contact point 4*a* of the contact 4 that has been depressed in the protective member 8 before the movement is positioned to be in plane with the top surface 5*a* of the first shell 5 and electrically coupled to the connecting terminal of the handheld device.

By further pressing the handheld device onto the top surface 5*a* of the first shell 5 (the top surface 8*a* of the protective member 8), the protective member 8, the first shell 5, the contact point 16*a* of the ground contact 16, and the contact point 4*a* of the contact 4 further move in the −Z direction by, for example, 0.2 mm (0.4 mm from the first position), and thereby the contact points 14*a* and 15*a* of the springs 14 and 15 of the second shell 12 are electrically coupled to the first shell 5. Since the handheld device and the electronic device on which the connector 2 is mounted are grounded not only via the first shell 5 and the ground contact 16 but also via the first shell 5 and the second shell 12, noise is further suppressed.

By further moving downward the protective member 8, the first shell 5, the contact point 16*a* of the ground contact 16, and the contact point 4*a* of the contact 4 by, for example, 0.6 mm, (1.0 mm from the first position), as illustrated in FIG. 12, the protective member 8 comes into contact with the base 3 to stop at where the top surface 5*a* of the first shell 5 is in plane with the top surface 3*e* of the base 3. Now the protective member 8 is in the second position where the top surface 5*a* of the first shell 5 is in plane with the top surface 3*e* of the base 3 and the contact point 4*a* is in plane with the top surface 5*a* (final connection state). In the final connection state, the contact point 4*a* is continuously energized upward by the elastic force of the compressed contact 4. Thus the contact point 4*a* is in contact with the connecting terminal of the handheld device with a sufficient contact force. So that the handheld device can surely be charged via the connector 10.

The connector 10 according to the second embodiment protects the contact point 4*a* by surrounding the contact point 4*a* within, namely, depressing the contact point 4*a* in, the protective member 8 having a simple structure. Thus a low cost connector with little chance of trouble can be provided. For example, since the contact point 4*a* is protected by being depressed in the protective member 8, deformation of or damage to the contact 4 caused by a finger or a pen touching the connector 10 positioned in the first position can be prevented.

The connector 10 according to the second embodiment includes the first shell 5 and the second shell 12 including the ground contact 16. The external device and the electronic device on which the connector 10 is mounted are securely grounded via the first shell 5, the second shell 6, and the ground contact 7. It is very difficult to manufacture conventional pressing-type connectors (e.g., a Pogo pin connector) with excellent high-speed transmission property. Besides, for the connector 10 according to the embodiment having secure grounding, improved high-speed transmission property can be provided. The ground contact 16 continuously couples with the ground of the external device via the first shell 5 during the period of time from the start of pressing the external device onto the connector 10 until the finish of the pressing, the period of pressing and the period of time from the start of releasing the pressing until the finish of releasing the pressing. This grounding is advantageous for building a sequence.

In the final connection state, the contact point 4*a* is in contact with the connecting terminal of the external device with a sufficient pressing force. With the contact point 4*a* being surrounded within, namely depressed in, the protective member 8 without the top portion of the contact 4 being excessively exposed out of the connector 10, the external appearance is preferable.

Figure 13:
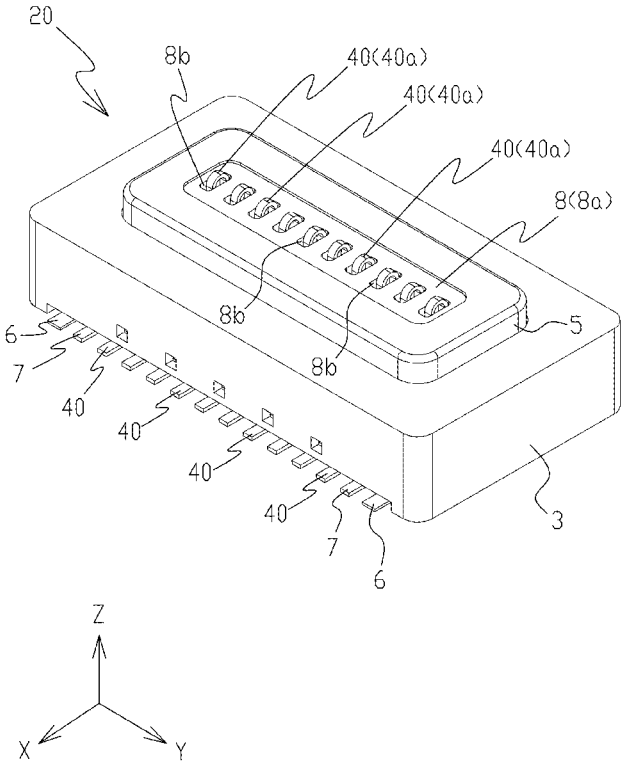
FIG. 13 is a perspective view illustrating a configuration of another connector according to the embodiment.

In each of the embodiments described above, although the contact point 4*a* of the contact 4 is positioned inside the protective member 8 in the first position, as in a connector 20 illustrated in FIG. 13, a contact point 40*a* of a contact 40 may project from a top surface 8*a* (an aperture 8*b*) of a protective member 8 in a first position. The contact 40 is configured the same as the contact 4 except for the projection of the contact point 40*a* from the top surface 8*a* (the aperture 8*b*) of the protective member 8.

Figure 14:
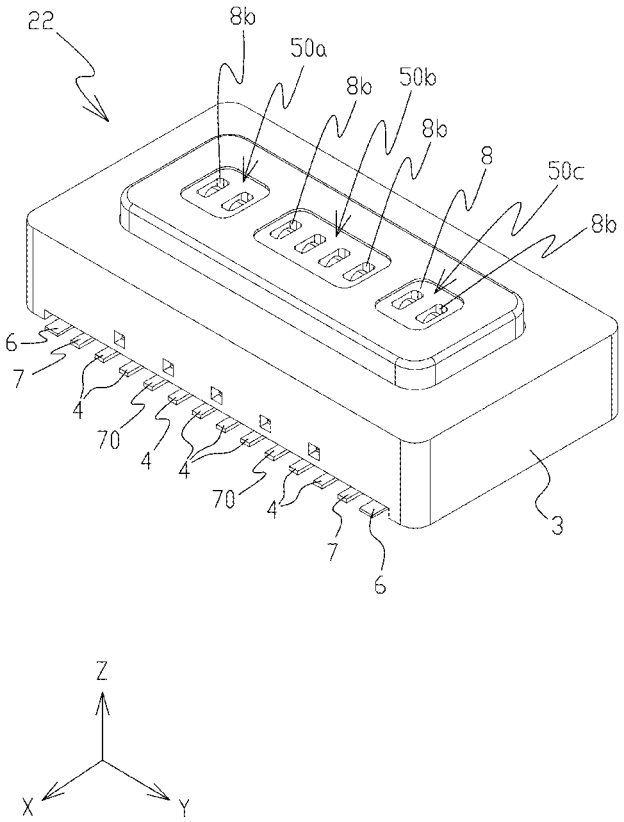
FIG. 14 is a perspective view illustrating a configuration of another connector according to the embodiment.

In each of the embodiments described above, the ground contacts are provided in both sides of the array of contacts 4 (along the Y direction). The ground contacts may be provided in both sides along the Y direction of at least one contact 4. That is, the ground contacts may be provided in both sides of the array of contacts 4 (along the Y direction), or alternatively, one or more ground contacts may be provided each between the contacts 4. For example, when two ground contacts 70 are provided each between the contacts 4 as in a connector 22 illustrated in FIG. 14, a first shell 50 is configured to have three apertures 50*a*, 50*b*, and 50*c* through which a plurality of apertures 8*b* is exposed. A hollow through which a portion of the first shell 50 is exposed to the −Z side is provided in the protective member 8. The contact point of the ground contact 70 is positioned in the hollow to continuously keep the ground contact 70 coupled to the portion of the first shell 50 exposed to the −Z side. The ground contact 70 is configured in a manner similar to the ground contact 7 so that the protective member 8 and the first shell 50 are continuously pushed up in the +Z direction by the elastic force of first elastic portions of the ground contacts 7 and 70.

Figure 15:
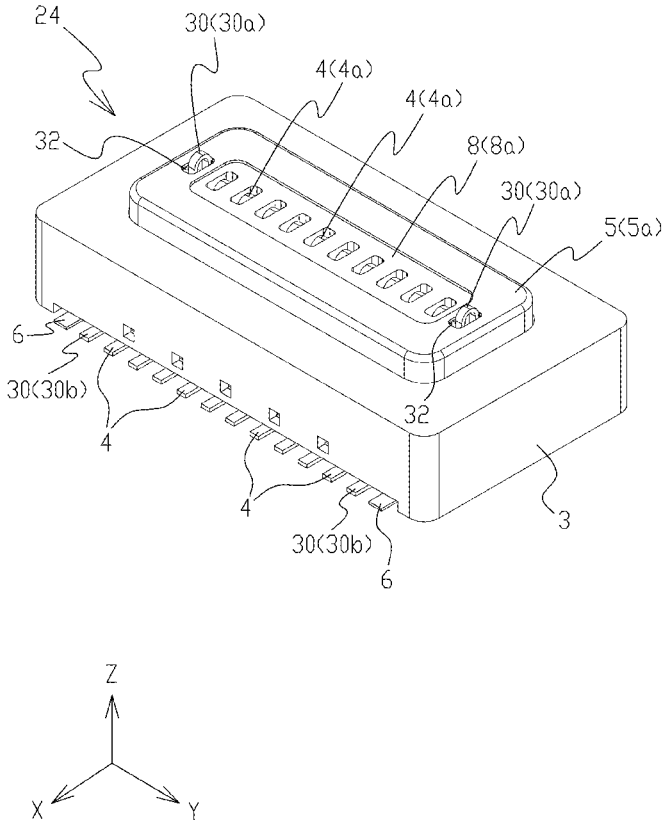
FIG. 15 is a perspective view illustrating a configuration of another connector according to the embodiment.

In each of the embodiment described above, although the contact point of the ground contact is in contact with the first shell 5 to push up the protective member 8 and the first shell 5, as in a connector 24 illustrated in FIG. 15, a contact point 30*a* of a ground contact 30 may project from an aperture 32 provided in a protective member 8 and a first shell 5.

Figure 16:
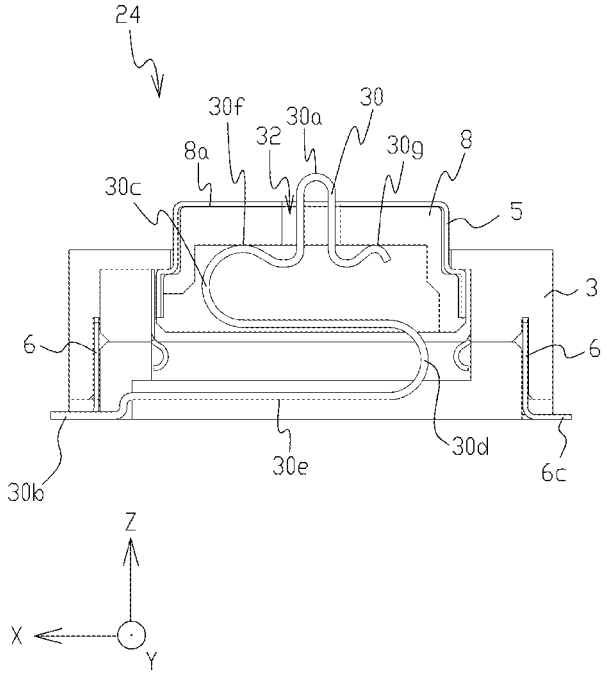
FIG. 16 is a sectional view illustrating a configuration of another connector according to the embodiment.

FIG. 16 is an XZ sectional view of the connector 24 viewed from the +Y side and also is a sectional view illustrating a configuration of the ground contact 30. In FIG. 16, a protective member 8 is positioned in a first position where a handheld device does not yet press in the −Z direction a top surface 8*a* of the protective member 8. As illustrated in FIG. 16, the ground contact 30 has two pushing-up portions 30*f* and 30*g* for pushing the protective member 8 up in the +Z direction, a contact point 30*a* provided between the pushing-up portions 30*f* and 30*g* to be electrically coupled to the first shell 5, an end portion 30*b* on the −Z side exposed through a second aperture 3*b* to be grounded, a first elastic portions 30*c* and 30*d* provided between the contact point 30*a* and the end portion 30*b*, and a first held portion 30*e* provided between the first elastic portion 30*d* and the end portion 30*b*. The two pushing-up portions 30*f* and 30*g* are continuously pushing the protective member 8 and the first shell 5 up in the +Z direction with the elastic force of the first elastic portions 30*c* and 30*d*.

In FIG. 16, the two pushing-up portions 30*f* and 30*g* of the ground contact 30 are in contact with the protective member 8 to push up the protective member 8 and the first shell 5. Alternatively, the two pushing-up portions 30*f* and 30*g* may be configured to make contact with the first shell 5 to push up the protective member 8 and the first shell 5. For example, a hollow through which the face of the first shell 5 facing the −Z side is exposed may be provided in the protective member 8, the pushing-up portion is positioned in the hollow, and the pushing-up portion make contact with the first shell 5.

In each of the embodiments described above, the ground contact is provided to continuously push up the protective member and the first shell. Alternatively, an elastic member may be provided in place of the ground contact to continuously push up the protective member and the first shell without grounding.

In each of the embodiments described above, the second shell includes six springs. Alternatively, the second shell may include one to five, or seven or more springs. In each of the embodiments described above, the exemplary configuration includes the second shell including a spring and the contact point provided on the end portion of the spring that makes contact with the first shell. Alternatively, it may be configured that the first shell includes a spring and the contact point provided on the end portion of the spring that makes contact with the second shell.

In each of the embodiments described above, the first shell 5 has a flat top surface 5*a*. Alternatively, the top surface 5*a* may have a protrusion, preferably one to three protrusions, to securely make contact with the ground of an external device. Each of the embodiments described above includes ten contacts 4. Alternatively, the embodiment may include one to nine or eleven or more contacts.

In each of the embodiments described above, the initial state before the external device presses the connector is exemplarily described as the first position, and the final connection state where the external device presses the connector is exemplarily described as the second position, so that the first position and the second position can easily be understood. These descriptions are not made by way of limitation on the first position and the second position. In each of the embodiments described above, the contact point is in plane with the surface of the protective member in the second position. Alternatively, the contact point may project from the surface of the protective member in the second position.

Figure 17:
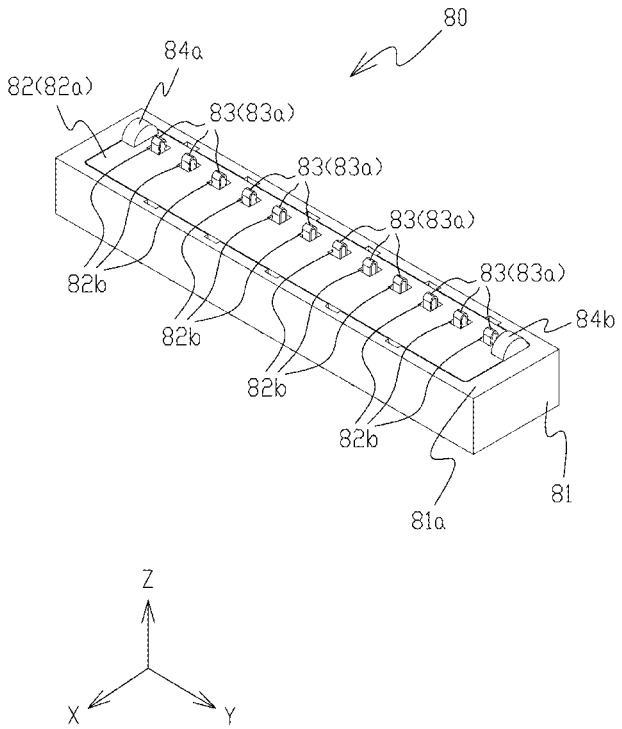
FIG. 17 is a perspective view illustrating an external appearance of a connector according to a third embodiment.

A connector according to a third embodiment of the present invention will now be described referring to the drawings. The connector according to the third embodiment is electrically coupled to an external device (not shown), such as a handheld device, when the connector is pressed by a connecting terminal provided on the pressing face of the external device. FIG. 17 is a perspective view illustrating an external appearance of the connector according to the third embodiment. In the drawings illustrating a configuration of the connector according to the embodiment, an XYZ orthogonal coordinate system similar to that in FIGS. 1 to 7 is defined. Positional relationship between members will be described with reference to the XYZ orthogonal coordinate system.

The connector 80 includes a base 81, a protective member 82, and a contact 83. The base 81 is formed of an insulative member having an approximately cuboid shape and accommodates the contact 83 and the protective member 82. A square-shaped aperture is provided on the top face 81*a* (facing the +Z side) of the base 81. The protective member 82 for protecting a contact point 83*a* of the contact 83 is positioned so as to be exposed out of the top face of the base 81 through the square-shaped aperture.

The protective member 82 is formed of an insulative member and allowed to move along the Z direction. The protective member 82 covers from above a plurality of (12, in the embodiment) contacts 83 accommodated in the base 81. On a pressed face 82*a*, onto which the pressing face of the external device is pressed, a plurality of (12, in the embodiment) square-shaped apertures 82*b* are formed along the Y direction. The contact point 83*a* of each of a plurality of contacts 83 projects toward the external device (the +Z side) through the aperture 82*b* from the pressed face 82*a*. The protective member 82 surrounds the contact point 83*a* of the contact 83 to protect the contact point 83*a*.

Two protrusions 84*a* and 84*b* each having an approximately half circular shape are provided on the pressed face

82*a* of the protective member 82. The two protrusions 84*a* and 84*b* are provided on the pressed face 82*a* with 12 contact points 83*a* therebetween. The protrusion 84*a* is provided in the −Y side of the array (along the Y direction) of contact points 83*a*, and the protrusion 84*b* is provided in the +Y side of the array (along the Y direction) of contact points 83*a*. Two protrusions 84*a* and 84*b* are larger in dimension along the Z direction than the contact point 83*a*. The pressing face of the external device to be pressed onto the connector 80 has recesses that can accommodate the two protrusions 84*a* and 84*b*. When the pressing face of the external device is pressed onto the pressed face 82*a* of the protective member 82, the two protrusions 84*a* and 84*b* are accommodated in the recesses provided in the pressing face of the external device. When the two protrusions 84*a* and 84*b* cannot be accommodated in the recesses provided in the pressing face of the external device, for example, when an object other than the external device presses the pressed face 82*a* of the protective member 82, the two protrusions 84*a* and 84*b* are pressed in the pressing direction (in the −Z direction) from the outside (for example, from an object other than the external device).

Figure 18:
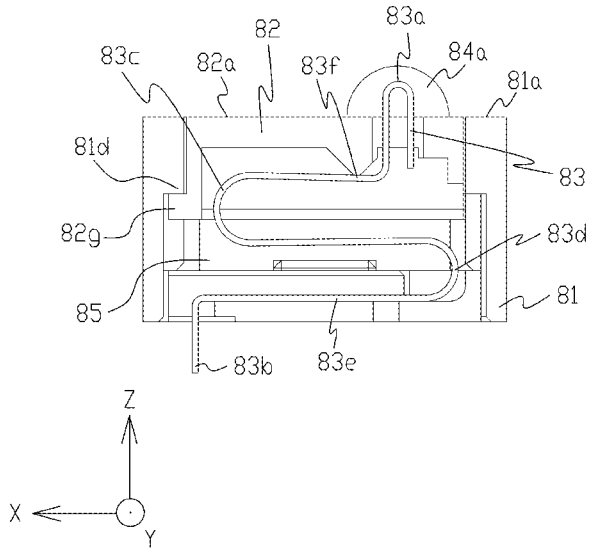
FIG. 18 is a sectional view illustrating a configuration of the connector according to the third embodiment.
Figure 19:
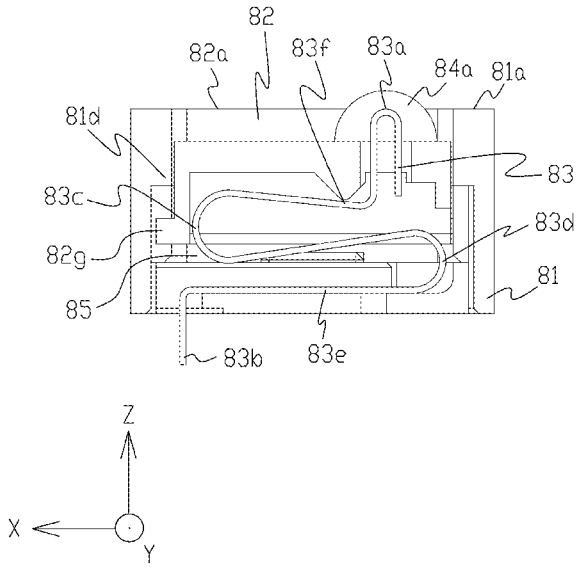
FIG. 19 is a sectional view illustrating a configuration of the connector according to the third embodiment.
Figure 20:
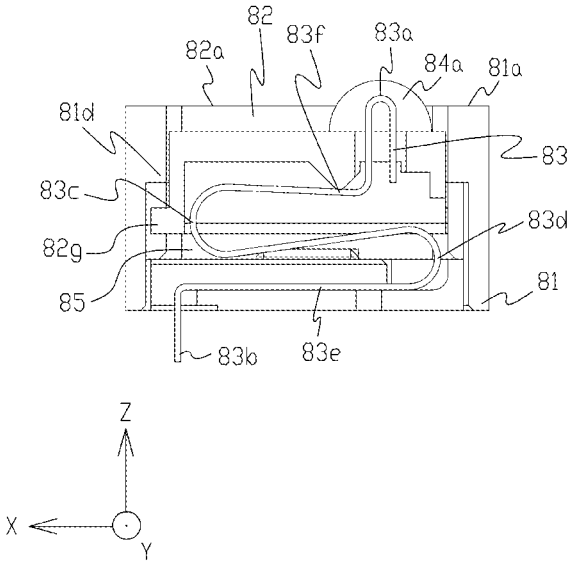
FIG. 20 is a sectional view illustrating a configuration of the connector according to the third embodiment.

FIGS. 18 to 20 are XZ sectional views of the connector 80 viewing from the +Y side. FIG. 18 illustrates a first state which will be described later. FIG. 19 illustrates a second state which will be described later. FIG. 20 illustrates another example of the first state. As illustrated in FIGS. 18 to 20, an inward protrusion 81*d* that protrudes toward the inside of the base 81 is provided in the +X side of the base 81. An outward protrusion 82*g* that protrudes toward the outside of the protective member 82 is provided in the +X side of the protective member 82. The inward protrusion 81*d* fixes the protective member 82 in the base 81. That is, when the protective member 82 moves in the +Z direction by a predetermined distance, the outward protrusion 82*g* engages with the inward protrusion 81*d*, so that the protective member 82 does not come off the base 81.

As illustrated in FIG. 18, the base 81 has inside an approximately cuboid-shaped hollow 85. The protective member 82 is arranged in the upper side of the hollow 85. The part of the base 81 for fixing and holding the contact 83 at predetermined position is arranged on the lower side of the hollow 9. The hollow 85 serves as a space allowing the protective member 82 to move in the −Z direction.

The contact 83 is formed of a conductive member having an approximately S-shape. The contact 83 has a contact point 83*a* provided on the top of the approximately S-shape and an end portion 83*b* in the −Z side to be coupled to a power controller or a signal controller of an electronic device on which the connector 80 is mounted. The contact point 83*a* of the contact 83 is electrically coupled to the connecting terminal of the external device when the connecting terminal provided on the pressing face of the external device is pressed onto the contact point 83*a*.

The contact 83 has a pressing portion 83*f* provided between the contact point 83*a* and the end portion 83*b*, elastic portions 83*c* and 83*d* provided between the pressing portion 83*f* and the end portion 83*b*, and a held portion 83*e* provided between the pressing portion 83*d* and the end portion 83*b*. In the first state, the pressing portion 83*f* presses the protective member 82 in the opposite direction (+Z direction) to the pressing direction of the pressing face of the external device (+Z direction). In the second state, the pressing portion 83*f* does not press the protective member 82 in the +Z direction. The embodiment includes a single pressing portion 83*f*. Alternatively, two or more pressing portions may be provided, for example, pressing portions may be provided in both sides of the contact point 83*a*. The elastic portions 83*c* and 83*d* press the contact point 83*a* in the +Z direction with the elastic force. The held portion 83*e* is held by the base 81 and receives the elastic force of the elastic portions 83*c* and 83*d*.

In the first state as illustrated in FIG. 18, the contact point 83*a* projects toward the external device (toward the +Z side) through the aperture 82*b*, and the pressing portion 83*f* presses the protective member 82 in the opposite direction (+Z direction) to the pressing direction of the pressing face of the external device (−Z direction). In the first state, the elastic portions 83*c* and 83*d* press the contact point 83*a* in the +Z direction by the elastic force and push up the protective member 82 in the +Z direction. Furthermore, the held portion 83*e* is held by the base 81 and receives the elastic force of the elastic portions 83*c* and 83*d*. In the first state, the protective member 82 is pushed up in the +Z direction by the pressing portion 83*f*, but the outward protrusion 82*g* engages with the inward protrusion 81*d*. Therefore the protective member 82 is fixed in the base 81 by the inward protrusion 81*d*, so that the protective member 82 does not come off the base 81. In the first state illustrated in FIG. 18, when the pressing face of the external device is in contact with the pressed face 82*a* of the protective member 82, the protrusions 84*a* and 84*b* are accommodated in the recesses provided in the pressing face of the external device.

In the second state as illustrated in FIG. 19, the contact point 83*a* is pressed in the −Z direction by making contact with the connecting terminal of the external device to be in plane with the top face 81*a* of the base 81. In the second state, the pressing face of the external device presses the pressed face 82*a* of the protective member 82, and the protrusions 84*a* and 84*b* are accommodated in the recesses provided in the pressing face of the external device. In the second state, the pressing portion 83*f* does not press the protective member 82 in the +Z direction. That is, the pressing of the pressing portion 83*f* against the protective member 82 in the +Z direction is released. In the second state, the elastic portions 83*c* and 83*d* are compressed and press the contact point 83*a* in the +Z direction by the elastic force, and the held portion 83*e* receives the elastic force of the elastic portions 83*c* and 83*d*. Since the pressing portion 83*f* does not press the protective member 82 in the +Z direction in the second state, the protective member 82 is allowed to move in the hollow 85 in the −Z direction to be supported by the base 81. In the second state in the embodiment, the contact point 83*a* is in plane with the top face 81*a* of the base 81, but alternatively, the contact point 83*a* may project from the top face 81*a* of the base 81. In the second state in the embodiment, the contact point 83*a* projects from the pressed face 82*a* of the protective member 82, but alternatively, it may be configured that the contact point 83*a* is in plane with the pressed face 82*a* of the protective member 82.

As illustrated in FIG. 20, for example, when an object other than the external device presses the pressed face 82*a* of the protective member 82 in the first state with the protrusions 84*a* and 84*b* not being accommodated in the recess, the contact point 83*a* projects toward the external device (toward the +Z side) through the aperture 82*b* and the pressing portion 83*f* presses the protective member 82 in the +Z direction to press the protective member 82 onto the pressing face of the external device, as in a manner similar to the case illustrated in FIG. 18. Similarly to the case illustrated in FIG. 18, the elastic portions 83*c* and 83*d* press the contact point 83*a* in the +Z direction to push up the protective member 82 in the +Z direction with the elastic force, and the held portion 83*e* is held by the base 81 and receives the elastic force of the elastic portions 83*c* and 83*d*. However, the case illustrated in FIG. 20 is different from the case illustrated in FIG. 18 in that the protrusions 84*a* and 84*b* are pressed in the −Z direction from the outside such as an object other than the external device. In the case illustrated in FIG. 20, the pressing portion 83*f* pushes the protective member 82 up in the +Z direction, but the protrusions 84*a* and 84*b* are pushed up by a greater pressing force than the pressing force of the pressing portion 83*f*. So that the outward protrusion 82*g* separates from the inward protrusion 81*d*, namely, the protective member 82 moves in the hollow 85 in the −Z direction.

How a handheld device, which is an external device, is attached to the connector 80 according to the third embodiment for charging will exemplarily be described. A user first prepares the connector 80 and a handheld device to be charged.

Before the handheld device presses the connector 80, the pressing portion 83*f* pushes up the protective member 82, and the inward protrusion 81*d* of the base 81 fixes the outward protrusion 82*g* of the protective member 82, as illustrated in FIG. 18. The pressed face 82*a* of the protective member 82 is in plane with the top surface 81*a* of the base 81 without the protective member 82 coming off the base 81 (initial state). The contact point 83*a* of the contact 83 is projecting from the pressed face 82*a* and the top surface 81*a*.

When the pressing face of the handheld device presses the pressed face 82*a* of the protective member 82, the protrusions 84*a* and 84*b* start being accommodated in the recesses provided in the pressing face of the handheld device, and the connecting terminal of the handheld device comes into contact with the contact point 83*a* of the contact 83. As the pressing face of the handheld device further presses the pressed face 82*a* of the protective member 82, the protrusions 84*a* and 84*b* are accommodated in the recesses provided in the pressing face of the handheld device, and the contact 83 is pressed in the −Z direction by the connecting terminal of the handheld device. The contact 83 is compressed along the Z direction and thereby the contact point 83*a* of the contact 83 moves in the −Z direction. When the contact point 83*a* of the contact 83 has moved in the −Z direction by a predetermined distance, the pressing of the pressing portion 83*f* for pushing up the protective member 82 in the +Z direction is released. Therefore the outward protrusion 82*g* of the protective member 82 separates from the inward protrusion 81*d* of the base 81. That is, the state changes from the first state where the pressing portion 83*f* is pressing the protective member 82 to the second state where the pressing portion 83*f* is not pressing the protective member 82.

When the pressing face of the handheld device further presses the pressed face 82*a* of the protective member 82 as illustrated in FIG. 19, the contact point 83*a* of the contact 83 comes to be in plane with the top surface 81*a* of the base 81 (final connection state). The contact point 83*a* is now coupled to the connecting terminal of the handheld device, and the protrusions 84*a* and 84*b* are accommodated in the recesses provided in the pressing face of the handheld device. The pressing portion 83*f* is no longer pressing the protective member 82 in the +Z direction. The compressed elastic portions 83*c* and 83*d* press the contact point 83*a* in the +Z direction with the elastic force. Since the pressing portion 83*f* is not pressing the protective member 82 in the +Z direction, the protective member 82 moves in the hollow 85 in the −Z direction to be supported by the base 81. In the final connection state, the contact point 83*a* is continuously energized upward by the elastic force of the compressed contact 83. Thus the contact point 83*a* is in contact with the connecting terminal of the handheld device with a sufficient contact force. So that the handheld device can surely be charged via the connector 80.

The connector 80 according to the third embodiment includes the protrusions 84*a* and 84*b* that are accommodated in the recesses provided in the pressing face of the external device, and this prevents any object other than the connecting terminal of the external device touching the contact point 83*a*. For a conventional pressing-type connector (i.e., a Pogo pin connector), a terminal (i.e., a Pogo pin) may be deformed or damaged when an object other than the external device presses the terminal. In contrast, for the connector 80 according to the embodiment, when an object other than the external device presses the pressed face 82*a* of the protective member 82, the protrusions 84*a* and 84*b* that are higher in dimension than the contact point 83*a* first come into contact with the object and are pressed. So that the contact between the object other than the external device and the contact point 83*a* is prevented. Therefore, deformation of or damage to the contact 83 caused by an object other than the external device making contact with the contact point 83*a* can be prevented. With the contact point 83*a* protected by surrounding the contact point 83*a* within the protective member 82 having a simple structure, a low cost connector with little chance of trouble can be provided. In the final connection state, the contact point 83*a* is in contact with the connecting terminal of the external device with a sufficient pressing force.

Figure 21:
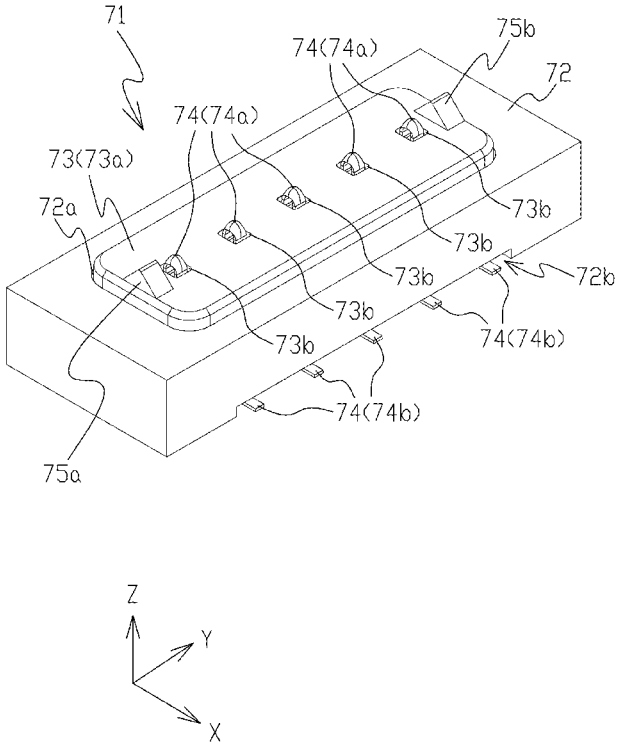
FIG. 21 is a perspective view illustrating an external appearance of another connector according to the embodiment.

The third embodiment includes two protrusions 84*a* and 84*b* each having an approximately half circular shape. Alternatively, protrusions 75*a* and 75*b* each having a triangular shape as illustrated in FIG. 21 may be provided. A connector 71 illustrated in FIG. 21 includes a base 72, a protective member 73, and a contact 74. The protective member 73 is positioned so as to project from the top face (facing the +Z side) of a base 72 through a first aperture 72*a* provided on the top face. An end portion 74*b* of a contact 74 exposed through a second aperture 72*b* provided in the lower portion of the face of the base 72 facing the +X side is coupled to a power controller or a signal controller of an electronic device on which the connector 71 is mounted. The protective member 73 is allowed to move along the Z direction. An aperture 73*b* through which a contact point 74*a* of each contact 74 projects toward an external device (toward the +Z direction) from the surface of the pressed face 73*a* of the protective member 73 is provided on the pressed face 73*a*.

As illustrated in FIG. 21, the two protrusions 75*a* and 75*b* each having an approximately half circular shape are provided on the pressed face 73*a* of the protective member 73. The two protrusions 75*a* and 75*b* are provided on the pressed face 73*a* with five contact points 74*a* therebetween. The protrusion 75*a* is provided in the −Y side of the array (along the Y direction) of contact points 74*a*, and the protrusion 75*b* is provided in the +Y side of the array (along the Y direction) of contact points 74*a*. The pressing face of the external device to be pressed onto the connector 71 has recesses that can accommodate the two protrusions 75*a* and 75*b*. When the pressing face of the external device is pressed onto the pressed face 73*a* of the protective member 73, the two protrusions 75*a* and 75*b* are accommodated in the recesses provided in the pressing face of the external device. When the two protrusions 75*a* and 75*b* cannot be accommodated in the recess provided in the pressing face of the external device, for example, when an object other than the external device presses the pressed face 73*a* of the protective member 73, the two protrusions 75*a* and 75*b* are pressed in the pressing direction (the −Z direction) from the outside (for example, from an object other than the external device). The contact 74 has a structure approximately similar to the contact 83 according to the third embodiment.

The protective member of the third embodiment includes two protrusions. Alternatively, three or more protrusions may be provided. In the third embodiment, two protrusions are provided with 12 (five, in FIG. 21) contact points therebetween. Alternatively, the protrusions may be provided with one to eleven (one to four, in FIG. 21) contact points therebetween. In the third embodiment, the two protrusions are provided to align in the Y direction. Alternatively, the two protrusions may be provided to align in the X direction or in the direction other than the X direction and the Y direction with contact points therebetween.

The third embodiment includes 12 contacts 83. Alternatively, the embodiment may include one to eleven or 13 or more contacts.

The embodiments explained above have been described so that the present invention is understood more easily, and are not intended to limit the present invention. Therefore, in this meaning, the respective elements, which are discussed in the respective embodiments described above, also include all of modifications of design and equivalents belonging to the technical scope of the present invention.

The invention claimed is:

1. A connector comprising:

a contact having a contact point that is electrically coupled to a connecting terminal of an external device by pressing the connecting terminal onto the contact point;

a protective member having a pressed face onto which the external device is pressed and an aperture, which is provided in the pressed face, for exposing the contact point from the pressed face, and movable between a first position and a second position;

a first shell covering the protective member with the aperture exposed;

a base accommodating the contact and the protective member; and a ground contact having a first elastic portion that pushes up the protective member and the first shell in an opposite direction to a pressing direction of the connecting terminal of the external device, having a first held portion held by the base, and being grounded, wherein the ground contact pushes up the protective member and the first shell with an elastic force of the first elastic portion, and the contact point of the contact is positioned inside the protective member at the first position, and a space is formed between a back face of the pressed face and the contact point at the first position.

2. The connector according to claim 1, further comprising:

a second shell that is assembled to the base and electrically coupled to the first shell, wherein the first shell has a second held portion that is held by the protective member, the second shell has a third held portion that is held by the base, the first shell or the second shell has a second elastic portion that is coupled to the second shell or the first shell, and the second shell is coupled to the first shell at least in the second position.

3. The connector according to claim 2, wherein the ground contact and the second shell are integrally formed.

4. The connector according to claim 1, wherein the contact has a pressing portion that, while the protective member is positioned between any one of positions from the first position to the second position and the second position, presses the protective member in the opposite direction to the pressing direction.

5. The connector according to claim 1, comprising:

at least two ground contacts disposed on both sides of the contact.

6. A connector comprising:

a contact having a contact point that is electrically coupled to a connecting terminal of an external device by pressing the connecting terminal onto the contact point;

a protective member having a pressed face onto which the external device is pressed and an aperture, which is provided in the pressed face, for exposing the contact point from the pressed face, and movable between a first position and a second position;

a first shell having a second held portion held by the protective member and covering the protective member with the aperture exposed;

a base accommodating the contact and the protective member;

an elastic member having a first elastic portion that pushes up the protective member and the first shell in an opposite direction to a pressing direction of the connecting terminal of the external device, and having a first held portion held by the base; and a second shell being assembled to the base, having a third held portion held by the base, and being electrically coupled to the first shell, wherein the first shell or the second shell has a second elastic portion having elastic force in a direction intersecting the pressing direction, one of the first shell or the second shell is pressed against the other of the first shell or the second shell by the elastic force of the second elastic portion so that the one of the first shell or the second shell is coupled to the other of the first shell or the second shell, and the second shell is coupled to the first shell at least in the second position.

7. The connector according to claim 6, wherein the elastic member is a ground contact which is grounded.

8. The connector according to claim 7, wherein the ground contact pushes up the protective member and the first shell with an elastic force of the first elastic portion, and the contact point of the contact is positioned inside the protective member at the first position, and a space is formed between a back face of the pressed face and the contact point at the first position.

9. The connector according to claim 7, comprising:

at least two ground contacts disposed on both sides of the contact.

10. The connector according to claim 7, wherein the ground contact and the second shell are integrally formed.

11. The connector according to claim 6, wherein the contact has a pressing portion that, while the protective member is positioned between any one of positions from the first position to the second position and the second position, presses the protective member in the opposite direction to the pressing direction.

12. A connector comprising:

a contact having a contact point that is electrically coupled to an external device by pressing a connecting terminal provided on a pressing face of the external device onto the contact point;

a protective member surrounding the contact point of the contact to protect the contact point; and a base being made of an insulative material and accommodating the contact and the protective member, wherein the protective member includes an aperture for projecting toward the external device from a surface of a pressed face onto which the pressing face of the external device is pressed, and at least two protrusions being provided in opposite sides of the contact point on the pressed face being higher than the contact point, wherein the contact includes at least a pressing portion that presses the protective member in an opposite direction to a pressing direction pressing the pressing face of the external device when in a first state and does not press the protective member in the opposite direction when in a second state, the contact point projects toward the external device from the aperture when in the first state, and the protrusion is pressed with a greater pressing force than a pressing force of the pressing portion in the pressing direction by an object other than the external device when the protrusion is not accommodated in a recess provided in the pressing face of the external device.

13. The connector according to claim 12, wherein, in the second state, the protrusion is accommodated in a recess provided in the pressing face of the external device and the contact point is coupled to the connecting terminal of the external device.

14. The connector according to claim 12, wherein the protrusion has a triangular shape.

15. The connector according to claim 12, wherein the base includes a fixing portion that fixes the protective member in the base, and the protective member includes an engaging portion that engages with the fixing portion.

* * * * *